United States Patent [19]

Bosch et al.

[11] 4,172,241

[45] Oct. 23, 1979

[54] ELECTROMAGNETIC ACTUATION DEVICE COMPRISING A MAGNETIC HOLDING MECHANISM, PARTICULARLY FOR THE ACTUATION OF HIGH-SPEED CIRCUIT BREAKERS

[75] Inventors: Hendrik A. Bosch, Hengelo; Derk van der Scheer, Goor, both of Netherlands

[73] Assignee: Hazemeijer B. V., Hengelo, Netherlands

[21] Appl. No.: 823,101

[22] Filed: Aug. 9, 1977

[30] Foreign Application Priority Data

Aug. 12, 1976 [NL] Netherlands ..... 7608975

[51] Int. Cl.[2] ..... H01H 9/00

[52] U.S. Cl. ..... 335/174; 335/203; 335/279

[58] Field of Search ..... 335/170, 174, 176, 203, 335/204, 266, 279

[56] References Cited

U.S. PATENT DOCUMENTS

| | | | |
|---|---|---|---|
| 3,048,679 | 8/1962 | Clausing | 335/170 |
| 3,215,799 | 11/1965 | Clausing | 335/174 X |

FOREIGN PATENT DOCUMENTS

| | | | |
|---|---|---|---|
| 2305468 | 6/1975 | Fed. Rep. of Germany | 335/266 |
| 927650 | 5/1963 | United Kingdom | 335/266 |
| 1002037 | 8/1965 | United Kingdom | 335/279 |
| 188595 | 10/1966 | U.S.S.R. | 335/266 |

*Primary Examiner*—George Harris

*Attorney, Agent, or Firm*—Watson, Cole, Grindle & Watson

[57] ABSTRACT

An actuation device which includes a holding magnet, an attracting magnet and an armature therebetween, both magnets being excitable by the same electromagnetic source. The armature comprises two half portions interconnected by a non-magnetic plate and operating such that upon saturation of the holding magnet with current, the armature will be disengaged by the holding magnet and drawn towards the attracting magnet.

3 Claims, 4 Drawing Figures

ELECTROMAGNETIC ACTUATION DEVICE COMPRISING A MAGNETIC HOLDING MECHANISM, PARTICULARLY FOR THE ACTUATION OF HIGH-SPEED CIRCUIT BREAKERS

BACKGROUND OF THE INVENTION

1. Field of the Invention

The invention relates to an actuation device, particularly for the actuation of a high-speed circuit breakers, and which mainly consists of an armature acting strokewise and a holding magnet and an attracting magnet which are excited by one and the same electromagnetic source, the attracting magnet drawing the armature towards itself when a previously determined current value is exceeded.

2. The Prior Art

Devices of the kind as mentioned above are universally known. In fact, when using one and the same magnetic flux source for the excitation of both the holding magnet and the attracting magnet, the speed of motion of the armature can be made to be superior to that with systems in which the holding magnet and the attracting magnet are excited individually. With the latter mentioned systems, the armature will be traversed by two different fluxes, and as a result, it will become over-saturated. In this manner, the holding force is unfavorably affected and the braking action of the holding circuit will increase upon the armature travelling.

Owing to the armature becoming over-saturated, its magnetic resistance to the magnetic flux of the holding circuit will increase, as a result of which the magnetic flux will rather tend to close via the air gap, due to which the holding force will decrease.

In order to keep this holding force sufficiently high to retain the armature, the attracting force can be reduced, either by decreasing the attracting flux or by preventing part of the attracting flux from passing via the armature, or the armature can be made of a more robust construction so that it may become less saturated. All these solutions have the disadvantage that the speed of the armature is unfavorably affected, either owing to the attracting force being reduced, or to the mass of the armature being increased.

It is known that, devices with armatures can be constructed, in which use is made of a flux excited by one and the same magnetic current source, both for the holding magnet and for the attracting magnet see German Pat. Nos. 1.087.679 and 1.102.252. In these cases, however, two magnetic systems are applied, in which the magnetic fluxes act simultaneously and in the same way upon a common armature.

Although, in this manner, a rather complicated assembly was obtained, this was necessary in order to realize a symmetric distribution of the holding and attracting forces upon the armature.

Another disadvantage is that one of the two air gaps between the attracting magnet and the armature is not perpendicular to the lines of flux, but forms an angle with these lines of flux, as a result of which the attracting force of the attracting magnet and, consequently, also the speed of the armature cannot be optimal. Also, due to the angle, the decrease in resistance in the attracting circuit will not equal the increase in resistance in the holding circuit since a widening of the air gap between the armature and the holding magnet will not cause a proportional narrowing of the air gap between the armature and the attracting magnet. Yet another disadvantage is that the excited flux is divided into a part for the holding circuit and a part for the attracting circuit. Only after the resistance in the holding circuit will have attained a certain value due to the air gap, will the greater part of the flux be used for the attracting circuit. Meanwhile, however, the armature will have already started moving. Consequently, the magnetic flux as a result of the current appearing due to a breakdown or short-circuit cannot be fully used for the tripping action.

Besides, the magnetic fluxes are generated with the aid of windings, so that these will have to be dimensioned to the current to be anticipated while the repelling forces in the windings in case of a short-circuit should likewise be taken into account.

SUMMARY OF THE INVENTION

It is an object of the present invention to avoid the aforesaid disadvantages and, to that end, provides a device of the kind as stated in the introduction, characterized in that the armature consists of two halves interconnected by a non-magnetic plate, due to which the magnetic flux, excited by means of a current conductor mounted in the attracting magnet, can be used in a simple manner for the excitation of both the holding magnet and the attracting magnet.

DESCRIPTION OF THE DRAWINGS

The invention will now be further explained with the aid of the drawing, in which.

DESCRIPTION OF THE PREFERRED EMBODIMENTS

Figure 1:
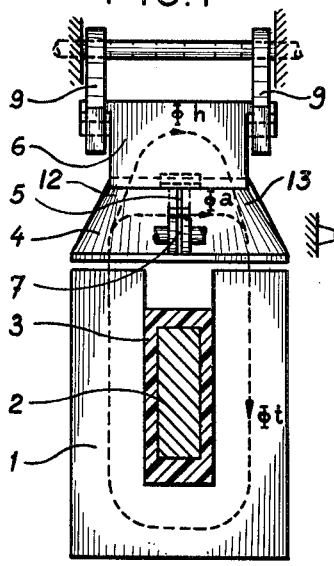
FIG. 1 shows a front view of an embodiment of the device of the present invention.
Figure 2:
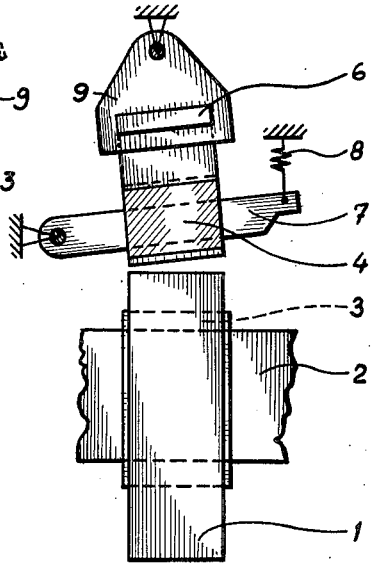
FIG. 2 shows a side-view of the embodiment of FIG. 1.

According to FIGS. 1 and 2, the inventive device includes a U-shaped attracting magnet 1, between the upstanding portions of which a current bar 2, which provides the magnetic current, is fixed; and a bushing 3, which provides the insulation between the current bar 2 and the attracting magnet 1.

The current passing through the current bar 2 generates a magnetic flux $\Phi t$ which will tend to close via the armature 4 situated over the attracting magnet 1. This is partly prevented due to the magnetic resistance of the armature 4 being heightened by a plate 5 of a non-magnetic material dividing the armature into two half portions 12 and 13. As a result, the magnetic flux $\Phi t$ will pass for the greater part via the holding magnet 6. When, due to a short-circuit, the current flowing through the current conductor or bar 2 increases considerably, the magnetic flux $\Phi t$ will also increase, the greater part $\Phi h$ passing via the holding magnet 6 until the passage from the armature 4 to the holding magnet 6 will have reached the saturation point. From that moment on, an increase in the magnetic flux $\Phi t$ will result almost exclusively in an increase of the component flux Φa, as a result of which the attracting force towards the magnet 1 will increase fairly rapidly, whereas the holding force towards the holding magnet 6 will not increase appreciably such that, ultimately, the armature 4 will be disengaged from the holding magnet 6.

The armature 4 is fastened to an arm 7, one extremity of which is pivotally secured to a fixed point, while the other extremity is also secured to a fixed point by means of a spring 8. With this structure, after the short-circuit has been removed, the armature 4 will again be drawn against the holding magnet 6 by means of the spring 8.

Via suspension plates 9, the holding magnet 6 is pivotally secured to a fixed point, as a result of which the holding magnet 6 will continually assume such a position that the contact surfaces of the armature 4 and of the holding magnet 6 will run parallel to each other.

By varying the thickness of the plate 5, the magnetic resistance of the armature 4 can be varied, as a result of which the magnetic flux Φa can be predetermined likewise.

The ratio between the holding force and the attracting force may be modified due to the change, in a manner known per se, of the active surfaces of the holding magnet 6 and the attracting magnet 1, and also by varying the length of the flux in the holding magnet 6, respectively.

Figure 3:
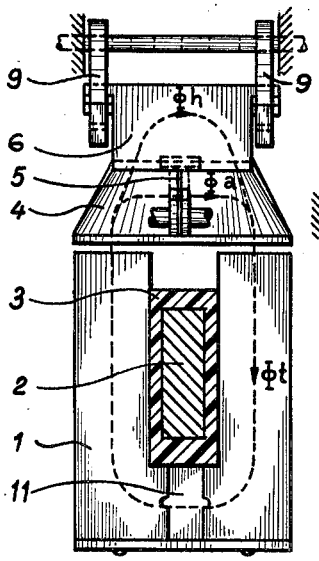
FIG. 3 shows a front view of a second embodiment of the device of the present invention, in which the distance between the armature and the holding magnet is increased more rapidly by means of springs, and in which a part of the attracting magnet is executed as a sliding block.
Figure 4:
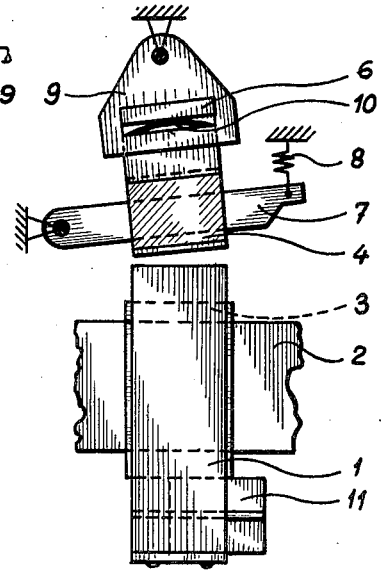
FIG. 4 is a side-view of the embodiment of FIG. 3.

FIGS. 3 and 4 show an embodiment in which the speed of motion of the armature 4 is increased. For this purpose, the holding magnet 6 and the suspension plates 9 are separated from each other by means of springs 10 at the position of the bearing surface.

When the armature 4 is drawn by the attracting magnet 1, the springs 10 will be stretched in the first instance. When the armature 4 is then disengaged from the holding magnet 6, the latter will be drawn away from the armature at an increased speed owing to the springs 10 being released while, simultaneously, the armature 4 is attracted by the attracting magnet 1 in the same manner as in the embodiment according to FIG. 1.

Due to this fast widening of the distance between the holding magnet 6 and the armature 4, the braking effect of the holding magnet 6 will rapidly decrease and the armature 4 will move faster.

FIG. 4 also indicates that part 11 of the attracting magnet 1 is slidingly mounted. Now, by more or less pushing this part 11 into the attracting magnet 1, it will be possible to vary the force of the attracting magnet 1. The attracting magnet 1 being divided in two halves as a result of the sliding part 11, it will be necessary to interconnect these two halves. This interconnection can be effected by mounting the parts in a housing of bakelite or similar material.

We claim:

1. In an actuation device, particularly for high-speed circuit breakers, comprising a stroke armature, a holding magnet, and an attracting magnet, the holding and the attracting magnet being excitable by one and the same electromagnetic source, the attracting magnet being capable of drawing the armature towards itself when a previously determined current value is exceeded, the improvement wherein the armature consists of two halve portions interconnected by means of a non-magnetic plate, a current conductor fixed in the attracting magnet for the excitation of both the holding magnet and the attracting magnet, the armature being positioned such that, upon saturation of the holding magnet, the armature will be disengaged by the holding magnet and drawn towards the attracting magnet.

2. A device according to claim 1, wherein springs are mounted to support the holding magnet, which springs are stretched when the armature is attracted to, and released when the armature is disengaged from, the holding magnet, and as a result of which the armature and the holding magnet will move in opposite directions so that the armature can move extremely fast.

3. A device according to claim 1, wherein a sliding part is mounted in the attracting magnet in order to vary the magnetic resistance of the attracting magnet and adjust the attracting force of the attracting magnet.

* * * * *